US005735788A

United States Patent [19]

Yasutake et al.

[11] Patent Number: 5,735,788

[45] Date of Patent: Apr. 7, 1998

[54] SIMPLE CLAMP TYPE MILL ROLL

[75] Inventors: Mutsumi Yasutake; Mitsuhiro Takatsuki; Kyoichi Takahara, all of Gifu-ken, Japan

[73] Assignee: Mitsubishi Materials Corporation, Tokyo, Japan

[21] Appl. No.: 551,247

[22] Filed: Oct. 31, 1995

[30] Foreign Application Priority Data

Jul. 24, 1995 [JP] Japan ..... 7-187513

[51] Int. Cl.[6] ..... B23P 15/00

[52] U.S. Cl. ..... 492/39; 492/40

[58] Field of Search ..... 492/1, 39, 40

[56] References Cited

U.S. PATENT DOCUMENTS

| | | | |
|---|---|---|---|
| 4,105,264 | 8/1978 | Zimmerman et al. | 492/1 |
| 4,114,416 | 9/1978 | Bier et al. | 492/1 |
| 4,841,612 | 6/1989 | Kark | 492/1 |
| 4,932,111 | 6/1990 | Kark | 492/1 |
| 5,483,812 | 1/1996 | Dempsey | 492/1 |

FOREIGN PATENT DOCUMENTS

| | | | |
|---|---|---|---|
| 585369 | 11/1958 | Italy | 492/39 |
| 7154302 | 9/1982 | Japan | 492/39 |
| 58-031243 | 7/1983 | Japan | 492/39 |
| 884753 | 11/1981 | U.S.S.R. | 492/39 |

*Primary Examiner*—Irene Cuda

*Attorney, Agent, or Firm*—Armstrong, Westerman, Hattori, McLeland & Naughton

[57] ABSTRACT

Annular rings are securely fixed to a shaft in a manner rendering them difficult to come loose, and easily mounted and removed. The rings, in the form of sleeves 21 and 22, are fitted over the outer periphery of a shaft 2 and fastened by a plurality of spacers in which a spacer 25 on one end of the rings is pressed by a belleville spring 27 which is compressed and deformed, and a spacer 23 on the other end of the rings is pressed by a head part **29*b* of a bolt 29 which is substantially parallel to an axis 0. The bolt 29 with a head is screwed to a screw hole 28*a* of a tightening nut 28 screwed to a screw part 2*b* of shaft 2**.

3 Claims, 3 Drawing Sheets

SIMPLE CLAMP TYPE MILL ROLL

BACKGROUND OF THE INVENTION

1. Field of the Invention

The present invention relates to a mill roll for rolling various types of materials, such as wire materials or bar steels.

2. Description of the Related Art

Hitherto, a sleeved roll, as shown in FIG. 2, has been widely used as this type of mill roll when longer service life and higher toughness are taken into consideration.

In this mill roll 1, a large-diameter portion 2*a* for fitting sleeves is formed in the central portion of a shaft 2. One or more, for example, two sleeves 3 in the illustrated arrangement, made from a hard material, such as an ultra-hard alloy, are fitted over the large-diameter portion 2*a*, and are secured by spacers (collars) 4 made from a hard material. The sleeves 3 and the spacers 4 are pressed against a flange 5 fixed to one end portion of the shaft 2, and a nut 6, threadedly engaging the other end portion of the roll, is tightened. In this manner, the sleeves 3 and the spacers 4 are pressed and fixed.

In such a mill roll 1, a very small gap is likely to occur between the cylindrical sleeves 3 and the spacers 4 during the rolling process. In order to prevent this gap, it is effective to make the tightening pressure by the nut 6 great. However, there is a limitation on the pressure which can be employed from a structural point of view.

In place of such mill roll 1, a mill roll 8 shown in FIGS. 3 and 4 has been proposed. In the mill roll 8, both sides of a sleeve 9 fitted to the shaft 2 are made to have tapered surfaces 9*a* in such a manner that the sleeve widens gradually from the outer peripheral surface toward the inner peripheral surface. A pair of spacers 10 are disposed each on opposite ends of the sleeve 9, with each spacer having one of its sides placed in abutment with the sleeve 9. Such side is made with a reversely tapered surface 10*a* which is inclined in a direction opposite to the tapered surface 9*a* of the sleeve 9. Furthermore, each spacer 10 has a keyway 12 to which a key 11 implanted in the shaft 2 is fitted to allow the sliding of the spacer 10 along the axis of the shaft 2, but preventing the rotation about the axis.

A ring-shaped belleville spring 14 is interposed between the fixed flange 5 and one of the spacers 10 in an elastically pressed state. And axially outside the other spacer 10, a hydraulic nut 16 having a hydraulic mechanism 15, depicted schematically, is screwed to the shaft 2. An annular piston 17 is disposed on the side of the hydraulic nut 16 facing the spacer 10, so as to be movable along the axis, and the spacer 10 is pressed toward the sleeve 9 by the free end portion of the piston 17.

In the mill roll 8 having such a construction, when fixing the annular sleeve 9, the hydraulic mechanism 15 of the hydraulic nut 16 is driven to make the piston 17 press and move the spacer 10 in opposition to the urging force of the belleville spring 14. As shown in FIG. 4, when the gap between the hydraulic nut 16 and the spacer 10 is sufficiently wide, a split ring 18 is inserted into this gap, and the pressurized state of the hydraulic nut 16 is released.

As a result, the compressed belleville spring 14 makes it possible to maintain the sleeve 9 at a pressed state under a large amount of pressure.

However, in the mill roll 8 comprising such a hydraulic mechanism 15, as described, if the hydraulic mechanism 15 breaks down or oil pressure leaks, the annular sleeve 9 cannot be fixedly set, and the mill roll 8 cannot be used.

SUMMARY OF THE INVENTION

In view of the above-described problem, it is an object of the present invention to provide a simple clamp type mill roll from which annular rings can be installed and removed easily and surely, and can be maintained strongly in a fixed state.

According to the present invention, there is provided a mill roll having an annular ring disposed about the outer peripheral surface of a shaft and having both ends of the annular ring fastened by spacers, wherein an elastic member for urging the annular ring toward an end via the spacer is fitted on one side of the ring, and a locking member containing a movable screw member for pressing the rolled ring toward the other end and against the other spacer is locked to the shaft on the other side of the annular ring.

The number of annular rings in the present invention is one or more. When the number of annular rings is two or more, of course, the present invention includes a case in which a spacer is provided between the respective annular rings.

The head part of the screw member presses the other spacer, and the shaft part of the screw member, which extends substantially parallel to said shaft, is screwed to the locking member.

The elastic member is a belleville spring.

The locking member is a nut screwed to the shaft.

According to the present invention, the annular ring is pressed and fixed from both sides of an elastic member which is compressed and deformed via one of the spacers and a screw member which extends against the other spacer. It is unlikely that the annular ring will come loose because it is fixed securely since the fixation pressure is great. Furthermore, since no hydraulic mechanism is used, mounting and removing operations are easy, and it is easy to deal with a case in which troubles, such as maintenance or replacement of parts, occur.

Also, since the spacer is pressed by the head part of a screw member, the pressing force is easily transmitted evenly.

For a better understanding of the invention, its operating advantages and the specific objectives obtained by its use, reference should be made to the accompanying drawings and description which relate to a preferred embodiment thereof.

DESCRIPTION OF A PREFERRED EMBODIMENT OF THE INVENTION

Figure 1:
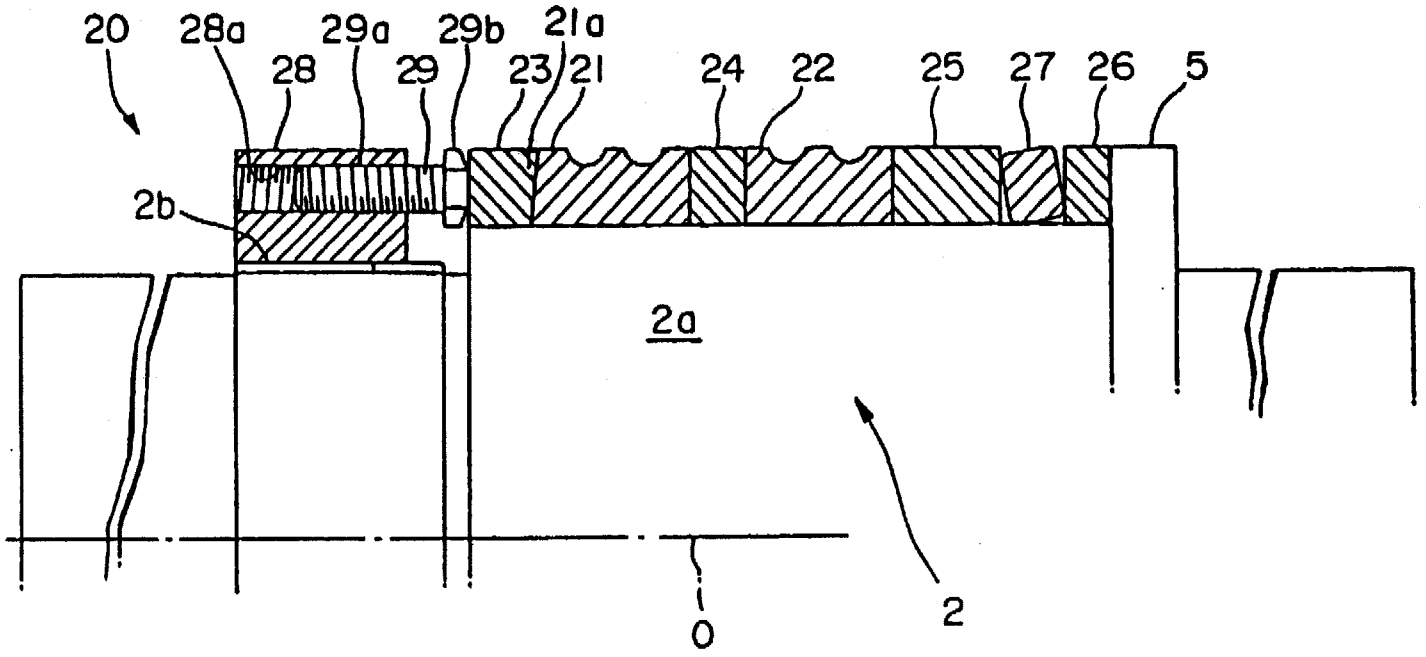
FIG. 1 is a sectional view of an essential portion of a mill roll in accordance with an embodiment of the present invention.
Figure 2:
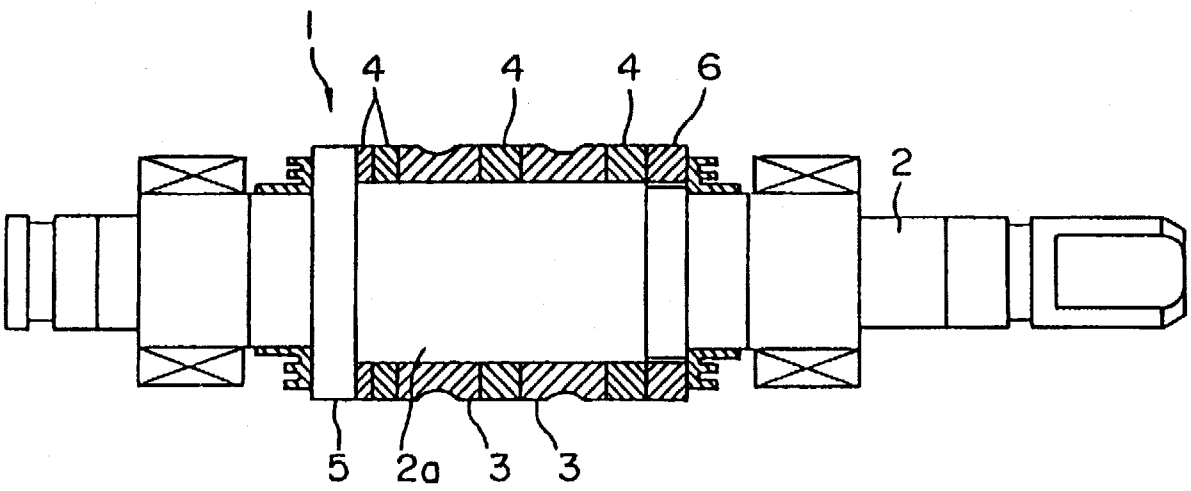
FIG. 2 Prior Art
FIG. 2 is a sectional view illustrating an example of a conventional mill roll.
Figure 3:
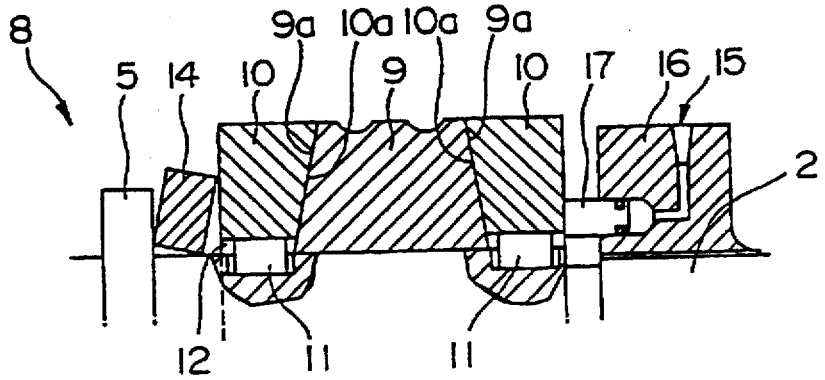
FIG. 3 Prior Art
FIG. 3 is a sectional view of an essential portion of another conventional mill roll before a sleeve is fixed.
Figure 4:
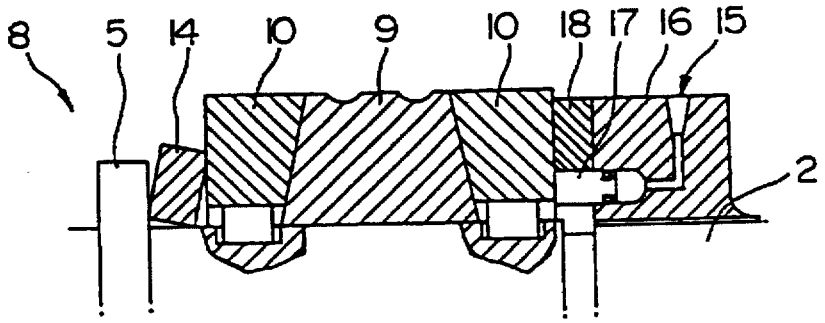
FIG. 4 Prior Art
FIG. 4 is a sectional view of an essential portion of the mill roll shown in FIG. 3 in a state in which a sleeve is fixed.

A preferred embodiment of the present invention will be described below with reference to FIG. 1. The components which are the same as those of the above-described prior art are given the same reference numerals, and an explanation thereof is omitted. FIG. 1 is a sectional view of an essential portion of a mill roll.

In a mill roll 20 in accordance with this embodiment, for example, two substantially cylindrical sleeves (annular rings) 21 and 22 are fitted over the outer peripheral surface of the large-diameter portion 2*a* of the shaft 2, and one side of one of the sleeves, indicated as 21, when viewed in cross section, is made with a tapered surface 21*a* which widens gradually from the outer peripheral surface toward the inner peripheral surface. In the illustrated example, three spacers 23, 24 and 25 are alternately fitted with respect to the sleeves 21 and 22 in such a way that the sleeve 21 is fastened by the spacers 23 and 24, and the sleeve 22 is fastened by the spacers 24 and 25. One side of a spacer 23 in abutment with the tapered surface 21*a* of the sleeve 21 is made with a reverse tapered surface 23*a*.

Referring to FIG. 1, a belleville spring 27 is disposed between the spacer 25 on the right end of a group of these sleeves 21 and 22 and the spacers 23, 24 and 25, and a spacer 26 adjacent to the flange 5 that is fixed to the shaft 2.

Further, outside the spacer 23, on the left end thereof, a tightening nut 28 serving as a locking member is screwed to a threaded part 2*b* of the shaft 2. An appropriate number of screw holes 28*a* are provided in the fastening nut 28 at predetermined intervals around the shaft 2 and are substantially parallel to the shaft axis 0, and a bolt 29 with a head 29*b* is screwed to the screw hole 28*a*. A shaft part 29*a*, which is threaded over the total length of the bolt 29 with head 29*b*, is screwed to the screw hole 28*a* and is substantially parallel to the axis 0, to press against the side of the spacer 23 adjacent to which the head portion 29*b* in the form of a substantially hexagonal plate is located.

The sleeves 21 and 22 are made from an ultra-hard alloy, and the spacers 23, 24, 25 and 26 are made from steel.

A mill roll 20 of this embodiment has the above-described construction. To fix the sleeves 21 and 22 to the shaft 2, the spacer 26 is first fitted to the shaft 2 in order to bring it into abutment with the flange 5, and then the belleville spring 27, the spacer 25, the sleeve 22, the spacer 24, the sleeve 21 and the spacer 23 are fitted in sequence, and the fastening nut 28 to which the bolt 29 with a head 29*b* is screwed to the screw part 2*b* of the shaft 2 leaving some space (or with no space).

The bolt 29 with head 29*b* extends from the screw hole 28*a* of the fastening nut 28 in order to press the adjacent spacer. As a result of the extension of the bolt 29 with a head in opposition to the urging force of the belleville spring 27, the belleville spring is compressed and deformed, and the sleeves 21 and 22 are pressed from both sides by the belleville spring 27 and the bolt 29 with a head via the spacers 23, 24 and 25, and are strongly fixed and maintained.

According to this embodiment, as described above, since the sleeves 21 and 22 are pressed and maintained from both sides, on one side by the belleville spring 27 which is compressed and deformed, and on the other side by the bolt 29 with a head, it is possible to press and maintain the sleeves 21 and 22 under great pressure, and it is unlikely that the sleeves will come loose. Furthermore, since no hydraulic mechanism is used as means of pressing the sleeves 21 and 22, pressing and releasing operations are easy, the danger that the sleeves fail is reduced, and it is easy to cope with maintenance or replacement of parts when a failure occurs.

Also, since the spacer 23 is pressed by the head part 29*b* of the bolt 29, the pressing force is likely to be transmitted evenly.

Although in the above-described embodiment the bolt 29 with a head is used as a screw member for pressing the adjacent spacer 23, a headless screw having no head part 29*b* may be used. In such case, a slit or the like may be formed in the end surface of the headless screw on a side opposite to the spacer 23.

Therefore, in the mill roll in accordance with the present invention, as described above, since an elastic member for urging annular rings fitted on a shaft toward one end is fitted on the shaft on one side of the annular rings, and at the other end of the shaft a locking member having a movable screw member to press the annular rings toward the elastic member is locked to a shaft, each annular ring is pressed and maintained from both sides by a compressed and deformed elastic member and a screw member. Thus, it is possible to fix and maintain the annular rings under a large amount of pressure, and it is unlikely that they will come loose. Furthermore, since no hydraulic mechanism is used as means for pressing the annular rings, mounting and removing operations are easy, and it is easy to deal with a case in which troubles, such as maintenance or replacement of parts, occur.

What is claimed is:

1. A mill roll comprising:

a cylindrical shaft having an annular flange fixedly secured to said shaft adjacent one end thereof and an externally threaded surface adjacent the other end thereof;

at least one annular ring having annular spacers disposed at axial ends of said ring concentrically received on said shaft between said annular flange and said externally threaded surface;

an elastic member fitted on said shaft intermediate said at least one annular ring and said annular flange and being operative engage a spacer and thereby urge said at least one annular ring in a direction away from said fixed flange;

an annular locking member having internal threads engageable with the external threaded surface of said shaft for threadedly securing said locking member to said shaft;

a plurality of internally threaded through holes disposed in said locking member at circumferentially spaced locations thereabout; and a plurality of screw members operative in said holes, each said screw member having an externally threaded shaft and an end having a constricted head for engaging a spacer adjacent thereto for thereby urging said at least one annular ring in a direction opposite to the direction of urging effected by said elastic member.

2. A mill roll according to claim 1 wherein each said screw member contains a head part for pressing said spacer and said threaded shaft screwed to said locking member extends substantially parallel to said cylindrical shaft.

3. A mill roll according to any one of claims 1 and 2 wherein said elastic member is a belleville spring.

* * * * *